US008608016B2

(12) United States Patent
Chiu et al.

(10) Patent No.: US 8,608,016 B2
(45) Date of Patent: Dec. 17, 2013

(54) FLEXIBLE STRAW MUG

(75) Inventors: Jeffrey Chiu, Woodridge, IL (US); David Starr, Woodridge, IL (US); Mason Umholtz, Woodridge, IL (US); Stephanie Guttas, Woodridge, IL (US); Traci Chapple, Woodridge, IL (US)

(73) Assignee: Wilton Industries Inc., Woodridge, IL (US)

( * ) Notice: Subject to any disclaimer, the term of this patent is extended or adjusted under 35 U.S.C. 154(b) by 0 days.

(21) Appl. No.: 13/299,936

(22) Filed: Nov. 18, 2011

(65) Prior Publication Data

US 2013/0126527 A1 May 23, 2013

(51) Int. Cl.
*A47G 21/18* (2006.01)

(52) U.S. Cl.
USPC ..... 220/705; 220/707; 220/709; 220/711

(58) Field of Classification Search
USPC ..... 220/705, 707, 709, 711; 215/388
See application file for complete search history.

(56) References Cited

U.S. PATENT DOCUMENTS

| | | | | |
|---|---|---|---|---|
| 5,201,460 | A | 4/1993 | Caines | |
| 5,259,538 | A | 11/1993 | Tardif | |
| 5,339,982 | A | 8/1994 | Tardie | |
| 5,346,081 | A | 9/1994 | Lin | |
| 5,361,934 | A | 11/1994 | Spence, Jr. | |
| 5,370,279 | A | 12/1994 | Tardif | |
| 5,465,866 | A | 11/1995 | Belcastro | |
| 5,520,304 | A | 5/1996 | Lin | |
| 5,582,320 | A | 12/1996 | Lin | |
| 5,897,013 | A | 4/1999 | Manganiello | |
| 6,050,433 | A | 4/2000 | Russell et al. | |
| 6,116,458 | A | 9/2000 | Dark | |
| 6,227,403 | B1 | 5/2001 | Kim | |
| 6,279,773 | B1 | 8/2001 | Kiyota | |
| 6,360,912 | B1 | 3/2002 | Lee | |
| 6,457,597 | B2 * | 10/2002 | Hirota et al. | 220/258.2 |
| 6,523,711 | B1 | 2/2003 | Hughes et al. | |
| 6,609,624 | B2 | 8/2003 | Goto et al. | |
| 6,745,949 | B2 | 6/2004 | Lee | |
| D543,767 | S | 6/2007 | Mather et al. | |
| 7,255,241 | B2 | 8/2007 | Yoneoka et al. | |
| 7,516,862 | B2 | 4/2009 | McDonough | |
| D603,206 | S | 11/2009 | Wallace | |
| 2004/0069783 | A1 | 4/2004 | Chen | |
| 2006/0186076 | A1 | 8/2006 | Shiloni | |
| 2006/0278649 | A1 | 12/2006 | Chern | |
| 2008/0169356 | A1 | 7/2008 | Trejo | |
| 2009/0255944 | A1 | 10/2009 | Yamashita et al. | |
| 2010/0170902 | A1 | 7/2010 | Britto et al. | |

FOREIGN PATENT DOCUMENTS

| | | |
|---|---|---|
| WO | WO 98/07633 | 2/1998 |
| WO | WO 2005/097612 A1 | 10/2005 |

* cited by examiner

*Primary Examiner* — Anthony Stashick
*Assistant Examiner* — Jennifer Castriotta
(74) *Attorney, Agent, or Firm* — Foley & Lardner LLP

(57) ABSTRACT

A straw having a flexible portion. The flexible portion of the straw is removably coupleable to a lid. The straw may be bent to engage a straw latch on the lid, sealing the straw.

16 Claims, 9 Drawing Sheets

FLEXIBLE STRAW MUG

FIELD OF THE INVENTION

The present invention relates generally to the field of containers. More specifically, the present invention relates to beverage containers having a straw.

BACKGROUND OF THE INVENTION

Beverage containers have utilized a variety of mechanisms to allow a user to drink the beverage contained therein. Typically, in order to provide the user with access to the contents of the container, an opening must be provided into the container. The user is then able to drink from the opening. However, the presence of the opening in the container also provides a possible pathway for the containers of the container to spill, such as when the beverage container is placed in a position where the opening is below the surface of the beverage container therein. For this reason, many beverage containers include a mechanism for closing the opening.

In addition to a general opening in a container, certain structures may be utilized to assist the user in the process of drinking from the container. One such structure is a straw, which provides a pathway connecting a user's mouth to the contents of the container. However, the presence of a straw may further exacerbate the problem of leakage from the container, as the straw provides a defined pathway out of the container.

SUMMARY OF THE INVENTION

One embodiment is directed to a container for liquid. The container comprises a liquid container body, a lid configured to engage the body, and a straw. The straw has an outer portion, an inner portion, and a flexible portion therebetween, each of the outer portion, inner portion, and flexible portion having a passageway therethrough. The outer portion has a first outer portion end and a second outer portion end, the second outer portion end securable with a first end of the flexible portion. The inner portion has an first inner portion end and a second inner portion end, the first inner portion end securable with a second end of the flexible portion. The flexible portion is engageable with the lid, wherein, the flexible portion passageway is sealed at a bend in the flexible portion.

One embodiment is directed to a closure mechanism comprising a lid configured to engage the body and a straw. The straw has an outer portion, an inner portion, and a flexible portion therebetween, each of the outer portion, inner portion, and flexible portion having a passageway therethrough. The outer portion has a first outer portion end and a second outer portion end, the second outer portion end securable with a first end of the flexible portion and the inner portion having an first inner portion end and a second inner portion end, the first inner portion end securable with a second end of the flexible portion. The flexible portion engageable with the lid, wherein, the flexible portion passageway is sealed at a bend in the flexible portion.

One embodiment is directed to straw having an outer portion, an inner portion, and a flexible portion therebetween, each of the outer portion, inner portion, and flexible portion having a passageway therethrough. The outer portion has a first outer portion end and a second outer portion end, the second outer portion end securable with a first end of the flexible portion and the inner portion having an first inner portion end and a second inner portion end, the first inner portion end securable with a second end of the flexible portion. The flexible portion engageable with the lid, wherein, the flexible portion passageway is sealed at a bend in the flexible portion.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The foregoing and other objects, aspects, features, and advantages of the disclosure will become more apparent and better understood by referring to the following description taken in conjunction with the accompanying drawings, in which.

DETAILED DESCRIPTION OF THE PREFERRED EMBODIMENTS

Figure 1:
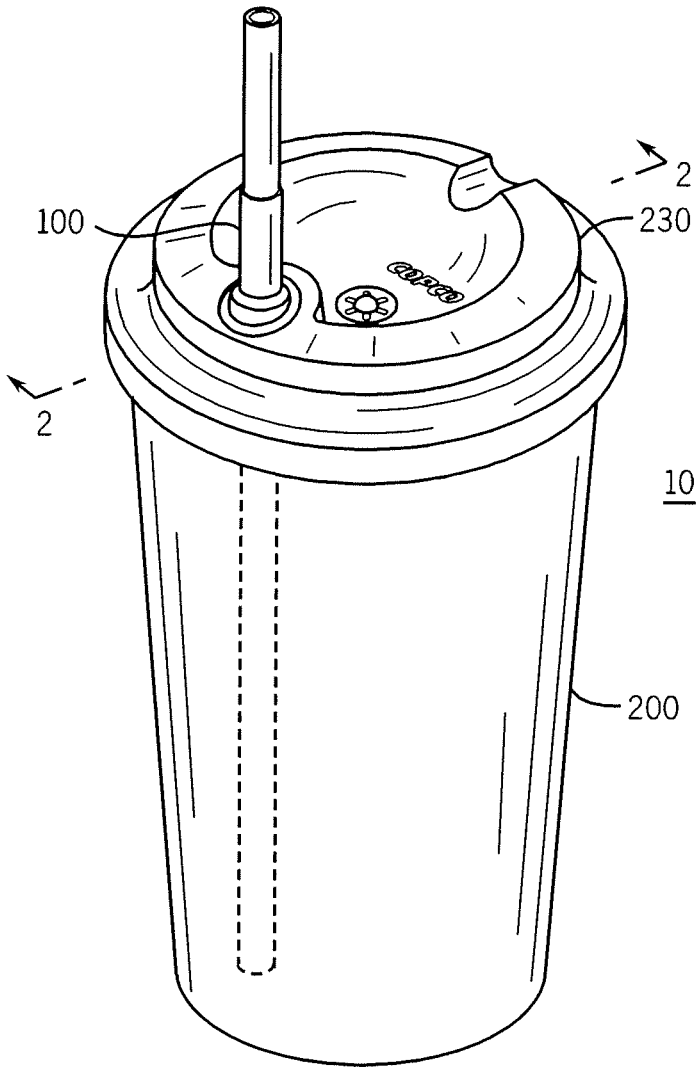
FIG. 1 is a perspective view of one embodiment of a container.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Figure 2:
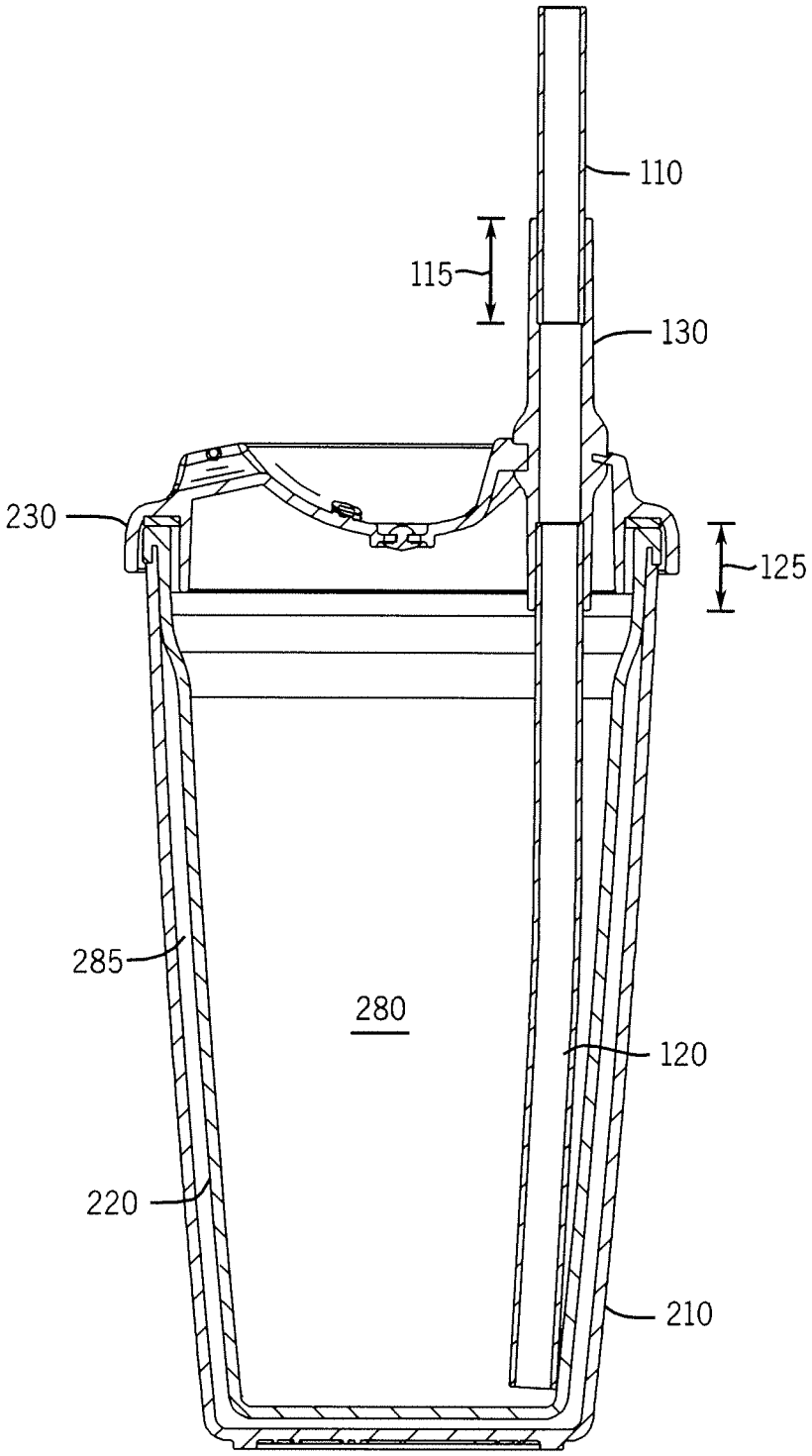
FIG. 2 is a cross-section of the container of FIG. 1 along A-A.

FIG. 1 illustrates one embodiment of a container 10 having a body 200, a lid 230 and a straw 100. FIG. 2 illustrates the container 10 of FIG. 1 in cross-section. The straw 100 extends from above the lid 230 through the lid 230 into a cavity 280 defined at least in part by the body 200. The straw 100 provides a defined fluid path from the cavity 280 (FIG. 2) to outside of the body 200, enabling a user to easily withdraw fluid from the container 10.

Figure 3A:
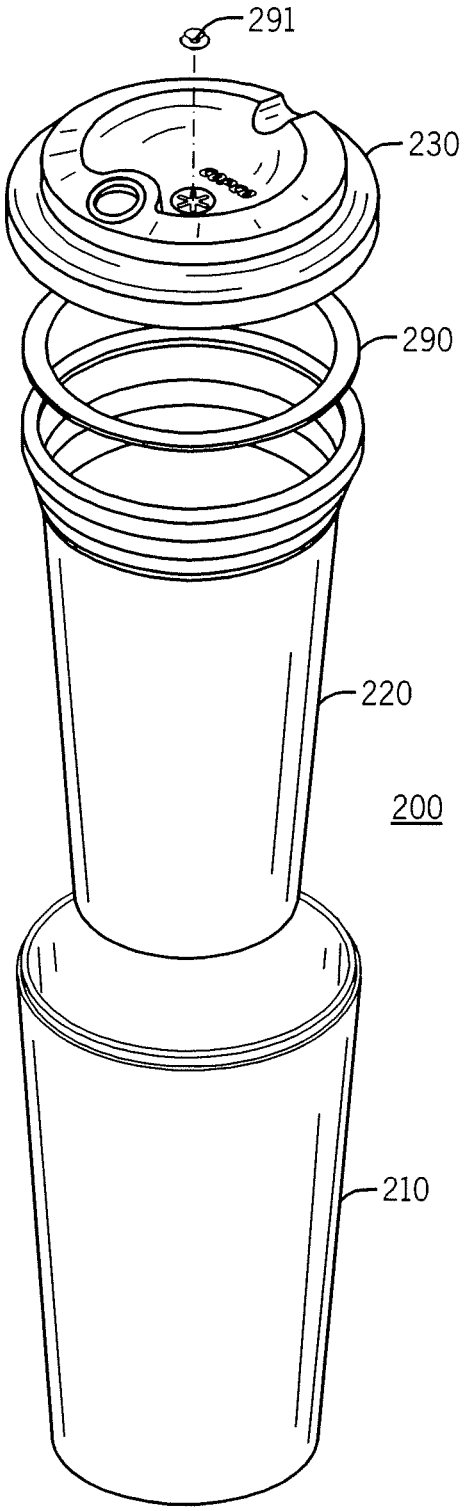
FIG. 3A is a disassembled view of a container.

FIG. 3A illustrates one embodiment of the body 200 and the lid 230. The body 200 defines a cavity 280 which is adapted to container the beverage or other material to be dispensed from the container 10. In one embodiment, the body 200 includes an inner body 220 and an outer body 210. This arrangement typically is referred to as a "double-walled" container and provides thermal benefits. The inner body 220 is disposed primarily within the outer body 210—as best shown in FIG. 2. The inner body 220 defines the cavity 280. The inner body 220 and outer body 210 may be secured together, such as by threading, slots, or other mechanisms allowing for removal. In addition, or alternatively, the inner body 220 and outer body 210 may be fixedly secured, such as by adhesive, sonic welding, or bonding. In one embodiment, an interstitial space 285 is formed between the inner body 220 and outer body 210. This space 285 may be filled with material, such as liquid and/or decorative substances. In addition, the interstitial cavity 285 may be created to substantially form a vacuum. The material in the space 285 may be such as to aid in temperature regulation of the fluid in the container 10.

FIG. 3A further illustrates the lid 230 for engaging the body 200. In one embodiment, the lid 230 is removably engageable with the body 200, such as by threads, slot and groove, snap-fit, friction fit, etc. A gasket 290 or other sealing mechanism may be provided at the interface of the lid 230 and the body 200. In one embodiment, the gasket 290 may be provided integral to the lid 230. The lid 230 includes a lid opening 240 though which the straw 100 passes as further described below.

Figure 3B:
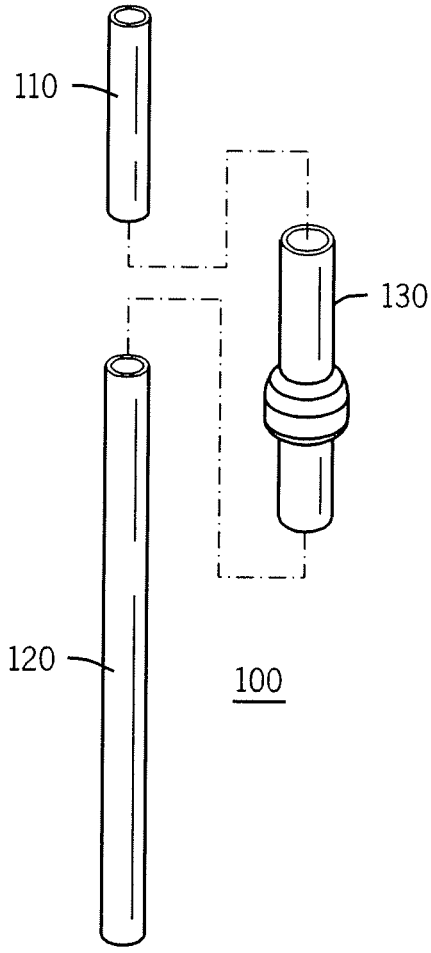
FIG. 3B is a disassembled view of a flexible straw.

FIG. 3B illustrates the straw 100. In the illustrated embodiment, the straw 100 includes an outer portion 110 and an inner portion 120 connected by a flexible portion 130. The outer portion 110 is adapted to extend from the flexible portion 130 substantially external to the lid 230 and body 200. The inner portion 120 is adapted to extend from the flexible portion 130 substantially internal to the lid 230 and body 200.

Figure 4A:
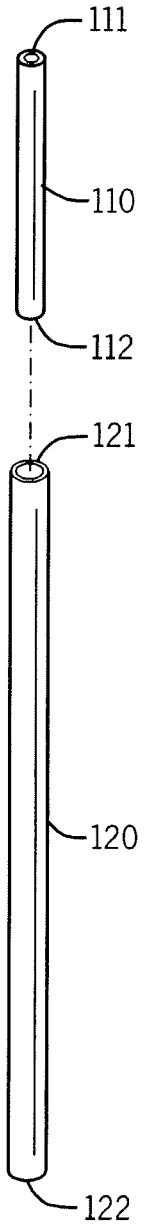
FIG. 4A is a perspective view of an upper straw portion and a lower straw portion.
Figure 4B:
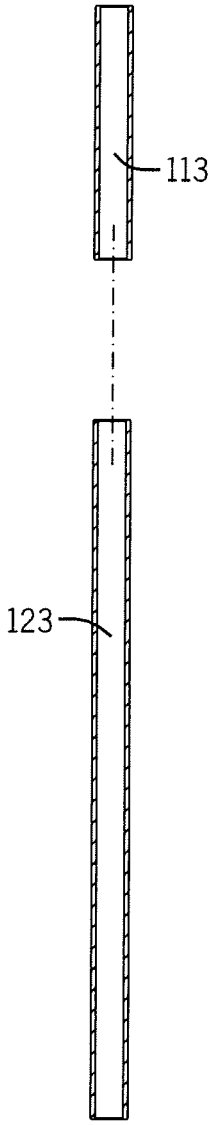
FIG. 4B is a front view of the upper and lower straw portions.
Figure 4C:
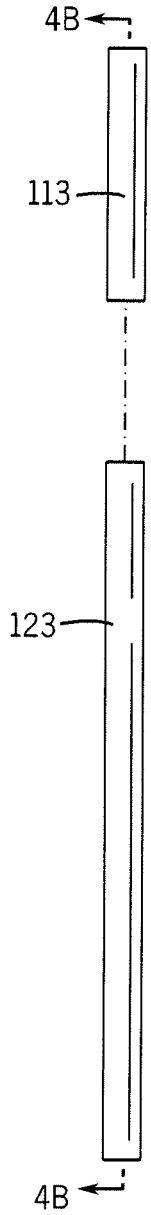
FIG. 4C is a cross-section along G-G of the upper and lower straw portions.

FIGS. 4A-C further illustrate one embodiment of the outer portion 110 and the inner portion 120. The outer portion 110 includes a first opening 111 and a second opening 112 with a passageway 113 defined therebetween. In one embodiment, the outer portion 110 has a generally cylindrical outer shape and the passageway 113 is generally cylindrical, such that the outer portion 110 is generally tube-like. In an alterative embodiment, the outer shape of the outer portion 110 may be other than cylindrical. In addition, the outer portion 110 may have an asymmetrical shape.

The inner portion 120 includes a first opening 121 and a second opening 122 with a passageway 123 defined therebetween. In one embodiment, the inner portion 120 has a generally cylindrical outer shape and the passageway 123 is generally cylindrical, such that the outer portion 110 is generally tube-like. In an alterative embodiment, the outer shape of the inner portion 120 may be other than cylindrical. In addition, the inner portion 120 may have an asymmetrical shape.

In one embodiment, the outer portion 110 is made of relatively—especially with regard to the flexible portion 130—rigid material, such as, but not limited to rigid plastic, metal, wood, or glass. The flexible portion 130 comprises a flexible material such as, but not limited to, flexible plastic or silicone. In one embodiment, the flexible portion 130 has a Shore D hardness of about 40. The inner portion 120 may be made of rigid material, in one embodiment, similar to that of the outer portion 110. In another embodiment, the inner portion 120 is made of a flexible material.

FIGS. 5A-F illustrate the flexible portion 130 of the straw 100. The flexible portion 130 includes a first end 131 and a second end 132 and a passageway 133 therebetween. In one embodiment, the flexible portion 130 includes a lid engagement section 136. The lid engagement section 136 engages the lid 230 to secure the straw 100 to the lid 230. In one embodiment, the lid engagement section 136 includes a groove 137 for receiving an inner circumference 238 of the opening 237 of the lid 230. For example, the lid engagement section 136 may be made of a flexible and resilient material such that the flexible potion 130 may snap-fit into the opening 237, such that the resilient portion 130 extends above and below the lid 230 and the inner circumference 238 is disposed within the groove 137.

Figure 5A:
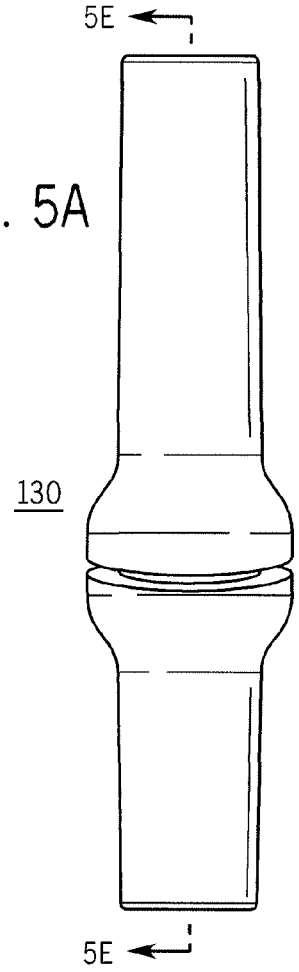
FIG. 5A is a front view of a flexible straw portion.
Figure 5B:
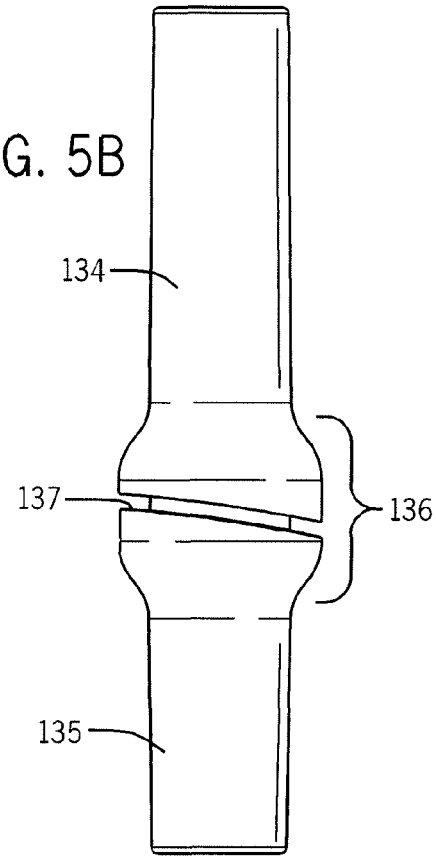
FIG. 5B is a side view of the flexible straw portion.
Figure 5C:
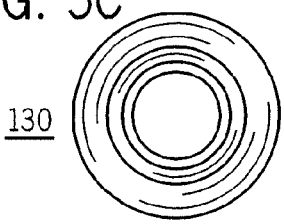
FIG. 5C is a top view of the flexible straw portion.
Figure 5D:
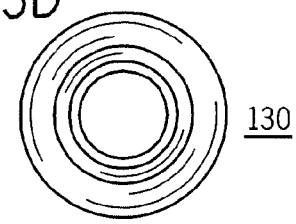
FIG. 5D is a bottom view of the flexible straw portion.
Figure 5F:
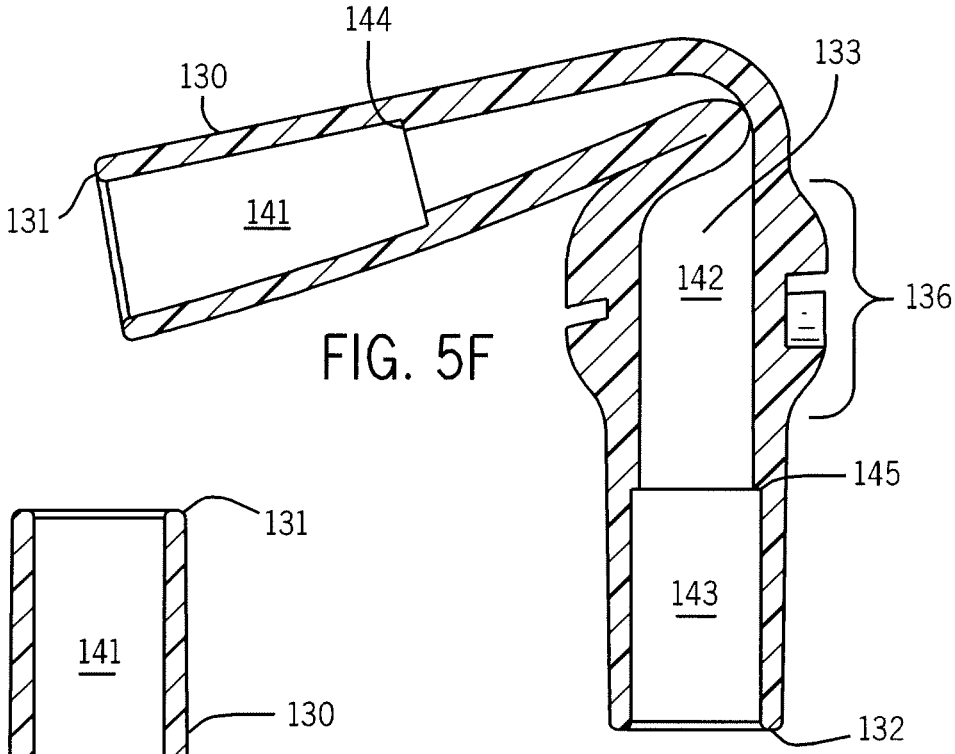
FIG. 5F is a cross-sectional view along H-H of the flexible straw in the sealed position.
Figure 5E:
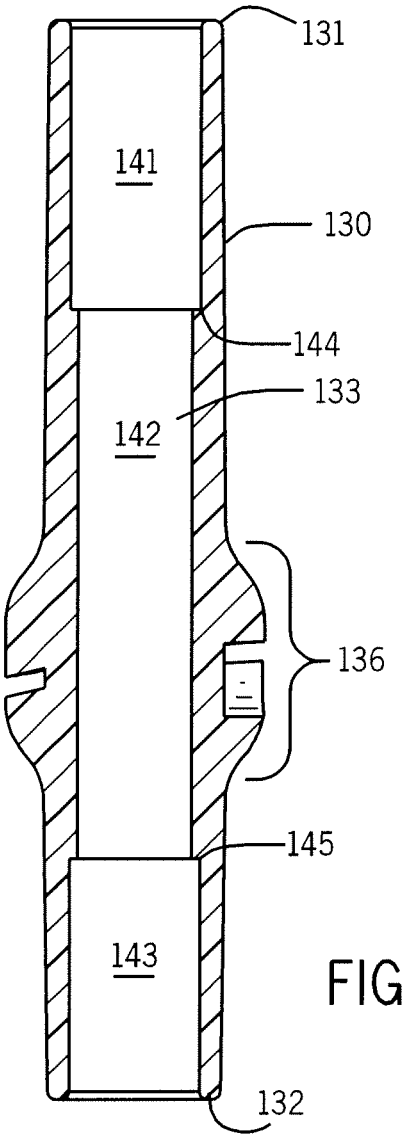
FIG. 5E is a cross-sectional view along H-H of the flexible straw portion in the dispensing position.
Figure 6A:
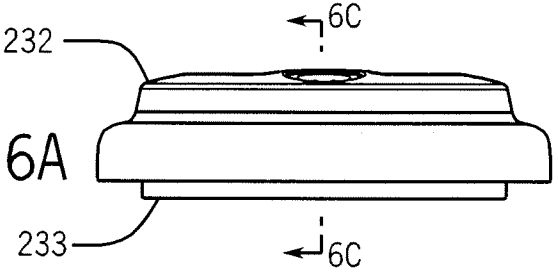
FIG. 6A is a front view of a lid.
Figure 6B:
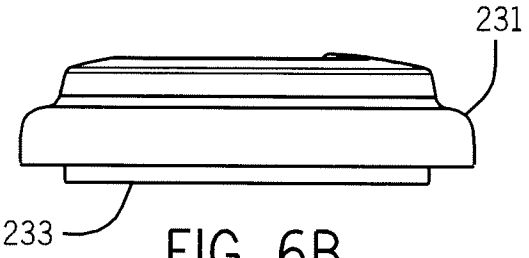
FIG. 6B is a side view of the lid.
Figure 6C:
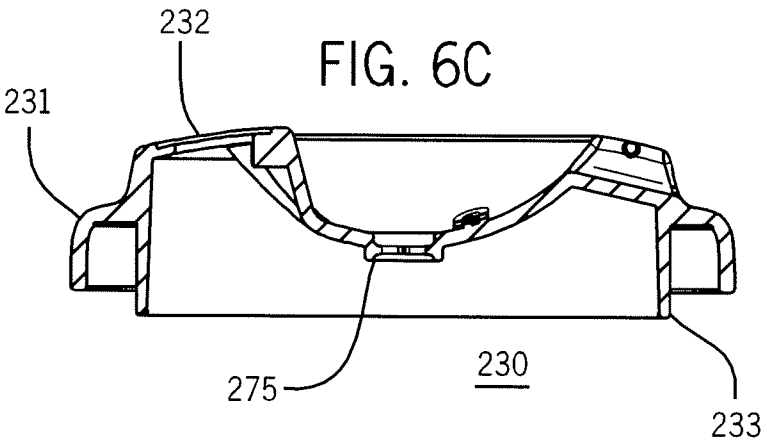
FIG. 6C is a cross-sectional view along 6C-6C of the lid.
Figure 6D:
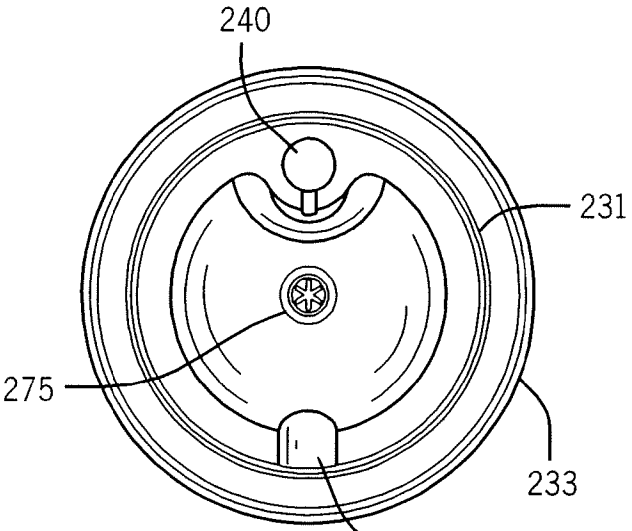
FIG. 6D is a bottom view of the lid.
Figure 6F:
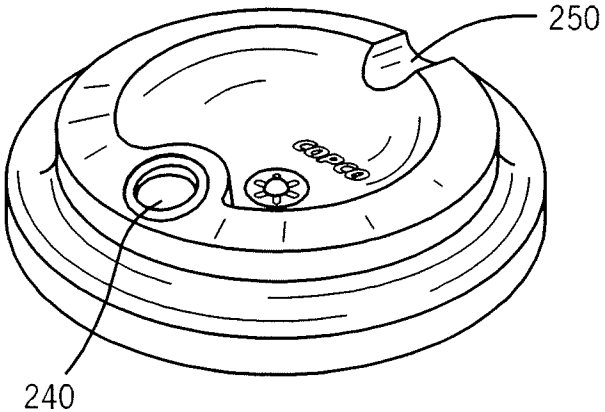
FIG. 6F is a perspective view of the lid.
Figure 6E:
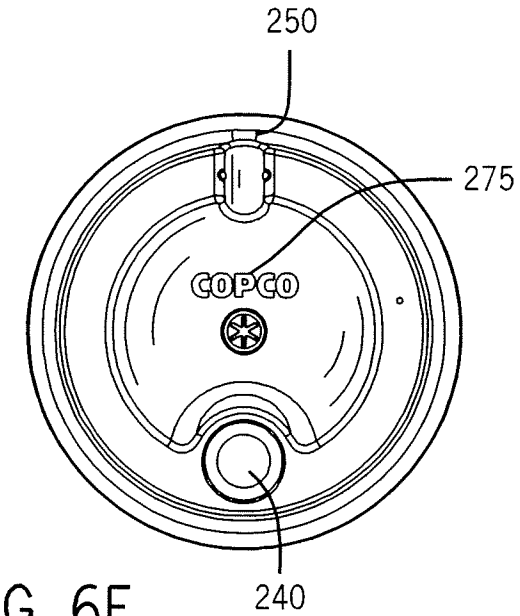
FIG. 6E is a top view of the lid.

In one embodiment, the flexible portion 130 is adapted to receive at least a section 115 of the outer portion 110, such that the outer portion retained section 115 is disposed within the flexible portion 130 and the remaining section 114 of the outer portion 110 extends from the flexible portion 130. As best illustrated in FIG. 5E, the passageway 133 of the flexible portion 130 may include an outer segment 141, a middle segment 142, and a inner segment 143. In one embodiment, the outer segment 141 and the inner segment 143 have a larger internal diameter than the middle segment 142. As a result, an upper annular ridge 144 and a lower annular ridge 145 may be provided. In one embodiment, the outer diameter of the outer portion 110 and the outer diameter of the inner portion 120 are such that the outer portion retained section 115 and inner portion retained section 125 are disposable within the respective outer segment 141 and inner segment 143. The middle segment 142 has a inner diameter smaller than the outer diameter of the outer portion 110 and the inner portion 130. Thus, when the outer portion 110 is inserted into the outer segment 141 of the flexible portion 130, the second end 112 of the outer portion 110 is adjacent to the upper annular ridge 144, which serves to prevent the outer portion 110 from being inserted into the middle segment 142 of the flexible portion 130.

FIGS. 6A-F, one embodiment of a lid is illustrated. The lid 230 may have an outer skirt 231, a top surface 232, and an inner skirt 233. The lid opening 240 may be in the top surface 232 or, alternatively, in one or both of the outer skirt 231 and/or the inner skirt 233. The inner skirt 233 may extend annularly downwardly from the top surface 232. The outer skirt 231 may extend annularly about the inner skirt 233. In one embodiment, the inner skirt 233 is concentrically positioned within the outer skirt 231. A vent 275 may be provided in the lid 230, such as, for example, in the top surface 232. The vent 275 may further include a gasket 291. The vent 275 may comprise a one-way check valve.

The lid 230 may further comprise a straw latch 250. The straw latch 250 is configured to receive a portion of the straw 100. In one embodiment, the straw latch 250 retains the outer portion 110 of the straw 100. For example, the outer portion 110 may snap-fit within a groove defining the straw latch 250. When the outer portion 110 of the straw 100 is engaged with the straw latch 250, the straw 100 is in the closed position. The straw 100 may be bent about the flexible portion 130 such that the upper portion is more than 90 degrees from vertical. In one embodiment, the upper portion 110 of the straw snap-fits within the straw latch 250, positioning the first end 111 of the outer portion 110 below a bend in the flexible portion 130. In other embodiments, the straw 100 may be held mechanically such as, but not limited to, by hook, latch, gate, adhesion, or friction fit.

Figure 7D:
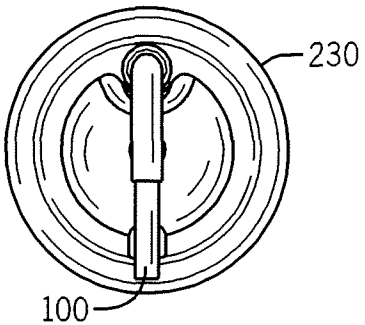
FIG. 7D is a top view of the sealed position of FIG. 7B.
Figure 7C:
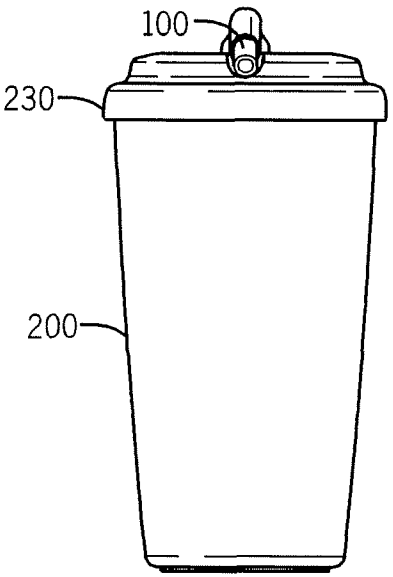
FIG. 7C is a front view of the sealed position of FIG. 7B.
Figure 7B:
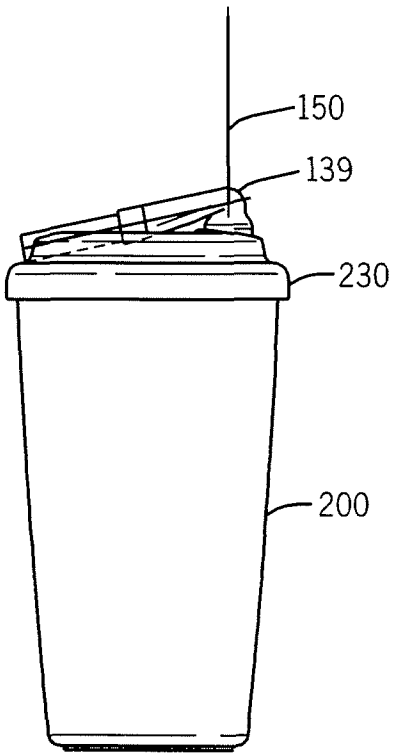
FIG. 7B is a side view of the beverage container with the straw in the sealed position.
Figure 7A:
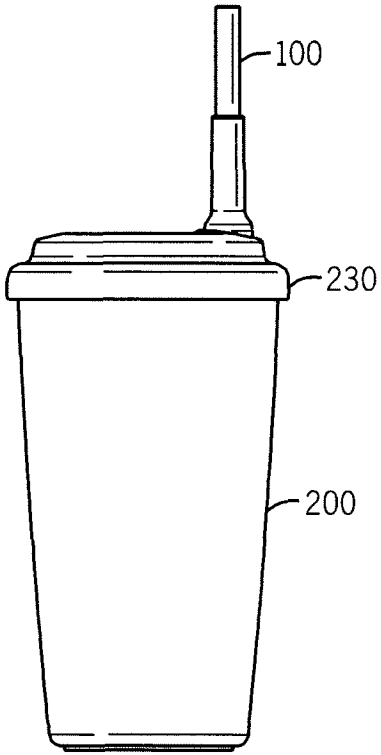
FIG. 7A is a side view of the beverage container with the straw in the dispensing position.

FIG. 7A illustrates the container in the opening position. FIGS. 7B-D illustrate the container in the closed position. When in the closed position, the straw 100 is bent about the flexible portion 130 to form a bend 139 in the flexible portion 130. The passageway 133 of the flexible portion 130, when in the closed position, is sealed.

When the drink straw 100 is in the up position, liquid may flow freely from the container through the straw 100. When the user is finished drinking, the drinking straw 100 is bent over and snapped into a retaining feature 250 on the lid 230. By doing this, the flexible portion 130 is crimped in half thus preventing liquid from flowing out the drinking straw end. In this way, a spill proof seal is created in the straw 100. After use, the straw 100 may be removed by the user and cleaned in the dishwasher. In one embodiment, the straw 100 is bent to about 105 degrees from vertical in the closed position. The closed position is such that the straw 100 is bent about the flexible portion sufficiently to be sealed. It should be appreciated that the angle with respect to vertical necessary to be sealed may vary within the scope of this invention dependent on the diameter of and materials comprising the flexible portion 130.

During use, the consumer will remove the lid 230 and fill the container 10 with liquid and reattach the lid 230. Then the liquid may be consumed through the straw 100. After drinking a portion of the liquid, the user can bend the straw 100 to the closed position and seal the container 10 to prevent spills. In this way, the container 10 is an easy to open and close using the straw 100.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A container for liquid comprising:

a liquid container body;

a lid configured to engage the body;

a straw having an outer portion, an inner portion, and a flexible portion therebetween, each of the outer portion, inner portion, and flexible portion having a passageway therethrough;

the outer portion having a first outer portion end and a second outer portion end, the second outer portion end securable with a first end of the flexible portion and the inner portion having a first inner portion end and a second inner portion end, the first inner portion end securable with a second end of the flexible portion; and the flexible portion disposable in an opening of the lid and including an annular groove engageable with a portion of the lid to removably and sealingly secure the flexible portion to the lid;

wherein, the flexible portion passageway is sealed at a bend in the flexible portion.

2. The container of claim 1, wherein the lid further comprises a straw latch configured to removably retain the straw.

3. The container of claim 1, wherein the outer portion of the straw is removably retainable by a straw latch of the lid.

4. The container of claim 1, wherein the straw is bent about the flexible portion such that the outer portion is more than 90 degrees from vertical.

5. The container of claim 4, wherein the outer portion of the straw snap-fits within a straw latch, positioning the first end of the outer portion below a bend in the flexible portion.

6. A closure mechanism comprising:

a lid configured to engage a body;

a straw having an outer portion, an inner portion, and a flexible portion therebetween, each of the outer portion, inner portion, and flexible portion having a passageway therethrough;

the outer portion having a first outer portion end and a second outer portion end, the second outer portion end securable with a first end of the flexible portion and the inner portion having a first inner portion end and a second inner portion end, the first inner portion end securable with a second end of the flexible portion; and the flexible portion disposable in an opening of the lid and including an annular groove engageable with a portion of the lid to removably and sealingly secure the flexible portion to the lid such that the flexible portion extends above and below the lid;

wherein, the flexible portion passageway is sealed at a bend in the flexible portion.

7. The closure mechanism of claim 6, wherein the lid further comprises a straw latch configured to removably retain the straw.

8. The closure mechanism of claim 7, wherein the outer portion of the straw is removably retainable by the straw latch of the lid.

9. A closure mechanism comprising:

a lid configured to engage a body;

a straw having an outer portion, an inner portion, and a flexible portion therebetween, each of the outer portion, inner portion, and flexible portion having a passageway therethrough;

the outer portion having a first outer portion end and a second outer portion end, the second outer portion end securable with a first end of the flexible portion and the inner portion having a first inner portion end and a second inner portion end, the first inner portion end securable with a second end of the flexible portion; and the flexible portion engageable and including an annular groove engageable with a portion of the lid to removably and sealingly secure the flexible portion to the lid;

wherein, the flexible portion passageway is sealed at a bend in the flexible portion, wherein the straw is bendable about the flexible portion such that the outer portion is more than 90 degrees from vertical.

10. The closure mechanism of claim 9, wherein the straw is bendable about the flexible portion such that the outer portion is about 105 degrees from vertical.

11. The closure mechanism of claim 9, wherein the outer portion of the straw snap-fits within a straw latch, positioning the first end of the outer portion below a bend in the flexible portion.

12. The closure mechanism of claim 9, wherein the flexible portion has a Shore D of about 40 or less.

13. A straw comprising:

an outer portion, an inner portion, and a flexible portion therebetween, each of the outer portion, inner portion, and flexible portion having a passageway therethrough;

the outer portion having a first outer portion end and a second outer portion end, the second outer portion end securable with a first end of the flexible portion and the inner portion having a first inner portion end and a second inner portion end, the first inner portion end securable with a second end of the flexible portion; and the flexible portion engageable and including an annular groove engageable with a portion of the lid to removably and sealingly secure the flexible portion to the lid;

wherein, the flexible portion passageway is sealed at a bend in the flexible portion such that the outer portion is more than 90 degrees from vertical.

14. The straw of claim 13, wherein the straw is bendable about the flexible portion such that the outer portion is more than 105 degrees from vertical.

15. The straw of claim 13, wherein the straw is sealed when the first end of the outer portion is positioned below a bend in the flexible portion.

16. The straw of claim 13, wherein the flexible portion has a Shore D of about 40 or less.

* * * * *